US006032424A

United States Patent [19]

Dial, Jr.

[11] Patent Number: 6,032,424

[45] Date of Patent: Mar. 7, 2000

[54] BLOCK SYSTEM

[76] Inventor: Ted C. Dial, Jr., P.O. Box 6130, Mobile, Ala. 36660

[21] Appl. No.: 09/270,888

[22] Filed: Mar. 17, 1999

Related U.S. Application Data

[60] Provisional application No. 60/078,992, Mar. 23, 1998.

[51] Int. Cl.[7] ..... E04B 2/00

[52] U.S. Cl. ..... 52/439; 52/607; 52/592.6; 264/247; 264/278; 249/96

[58] Field of Search ..... 52/607, 600, 592.6, 52/125.2, 125.4, 439, 421, 742.14, 745.1, 745.2, 747.12; 264/247, 278, 333; 249/96, 144, 160, 52, 175

[56] References Cited

U.S. PATENT DOCUMENTS

| | | | |
|---|---|---|---|
| D. 131,814 | 3/1942 | Larson | 52/316 |
| 680,138 | 8/1901 | Fenner . | |
| 805,478 | 11/1905 | Lorscheider | 52/600 |
| 869,770 | 10/1907 | Birnstock | 52/600 |
| 2,344,206 | 3/1944 | Forni . | |
| 2,453,466 | 11/1948 | Slobodzian . | |
| 2,647,392 | 8/1953 | Wilson | 52/421 |
| 2,701,464 | 2/1955 | Kyle et al. | 52/421 |
| 3,187,694 | 6/1965 | Crookston et al. . | |
| 3,724,141 | 4/1973 | Kelleher . | |
| 4,018,018 | 4/1977 | Kosuge | 52/607 |
| 4,075,808 | 2/1978 | Pearlman . | |
| 4,510,725 | 4/1985 | Wilson . | |
| 4,514,949 | 5/1985 | Crespo | 52/607 |
| 4,854,097 | 8/1989 | Haener | 52/439 |
| 5,487,526 | 1/1996 | Hupp . | |
| 5,644,871 | 7/1997 | Cohen . | |
| 5,729,944 | 3/1998 | De Zen . | |

FOREIGN PATENT DOCUMENTS 38886 of 1956 Poland .

*Primary Examiner*—Carl D. Friedman
*Assistant Examiner*—Dennis L. Dorsey

[57] ABSTRACT

A construction block is disclosed along with a method of producing and assembling a plurality of the construction blocks where the blocks have internal cages around a central passage, said central passage opening to top, bottom or side openings in the blocks, and from which cage support rods extend to hook chain lifts to the blocks and to guide bottom openings of top blocks into predetermined alignment with the top opening of the bottom blocks. The casting technique allows not only for the novel lifting and alignment construction of the blocks, but also allows for novel external and internal features to be incorporated into the blocks, such as mounting bolts for interior walls and bricks or brick facades for the exterior walls of the blocks.

20 Claims, 14 Drawing Sheets

BLOCK SYSTEM

PRIORITY

Priority is claimed on PROVISIONAL PATENT no: 60/078,992 filed Mar. 23, 1998 by Ted Dial.

KNOWN PRIOR ART

The prior art shows embedded lifting mechanisms. The prior art also shows building members and concrete building members having hollow interiors. The prior art also shows building members assembled to receive a concrete matrix.

GENERAL DISCUSSION OF THE INVENTION

The invention is a specialized building block and a building process using the specialized blocks for constructing walls, building exteriors and decorative architectural detail such as cornices, eaves, window and door casings and Lintels built independently and in conjunction with walls. A process for constructing the blocks is also taught. The invention uses blocks which, when assembled, have a series of intersecting chambers which allow for a continuous concrete pour throughout the structure in order to secure the blocks together. The blocks are defined by specialized exterior features, by the channel system, by the cage and opening layout for lifting and centering one block on top of another.

In this way a very strong structure is made where certain architectural details become part of the structure as opposed to merely being mounted onto the structure or attached to the structure. No attachment devices or fasteners are needed as are found in other known practices of constructing architectural details such as eaves, cornices and the like. Incorporation of these features into poured block structures which are integral parts of the exterior walls saves time and labor costs.

In the preferred embodiment, the products are prefabricated and stacked for shipping and construction. No exterior finishes are required to be added during construction because all desired finishes and desired shapes, both decorative and functional, are already part of this structural product. The structural integrity of the building (framing, etc), the interior finish surfaces, the weather controlling aspect, and the complete decorative aspect are all one and the same in this product.

It is therefore an object of the invention to provide an easily constructed and moved building member.

Another object of the invention is to provide a block which can easily be lifted in place by at least one lifting rod and thereafter stacked and filled with concrete or other matrix without the rod interfering with the concrete pour.

It is a further object of the invention to provide for a process for using the modified blocks in order to construct structures with desired architectural detail with minimal labor.

These and other objects and advantages of the invention will become better understood hereinafter from a consideration of the specification with reference to the accompanying drawings forming part thereof, and in which like numerals correspond to parts throughout the several views of the invention.

BRIEF DESCRIPTION OF THE DRAWINGS

For a further understanding of the nature and objects of the present invention, reference should be made to the following detailed description taken in conjunction with the accompanying drawings in which like parts are given like reference numerals and wherein:

FIG. 2(*b*) is a plan view of a jig having a notched centering means and raised guides for building properly centered cages.

FIG. 4*b* is a cross section of FIG. 4*a* through the 4*b*—4*b* axis.

DETAILED DESCRIPTION OF THE PREFERRED EMBODIMENT

Figure 1:
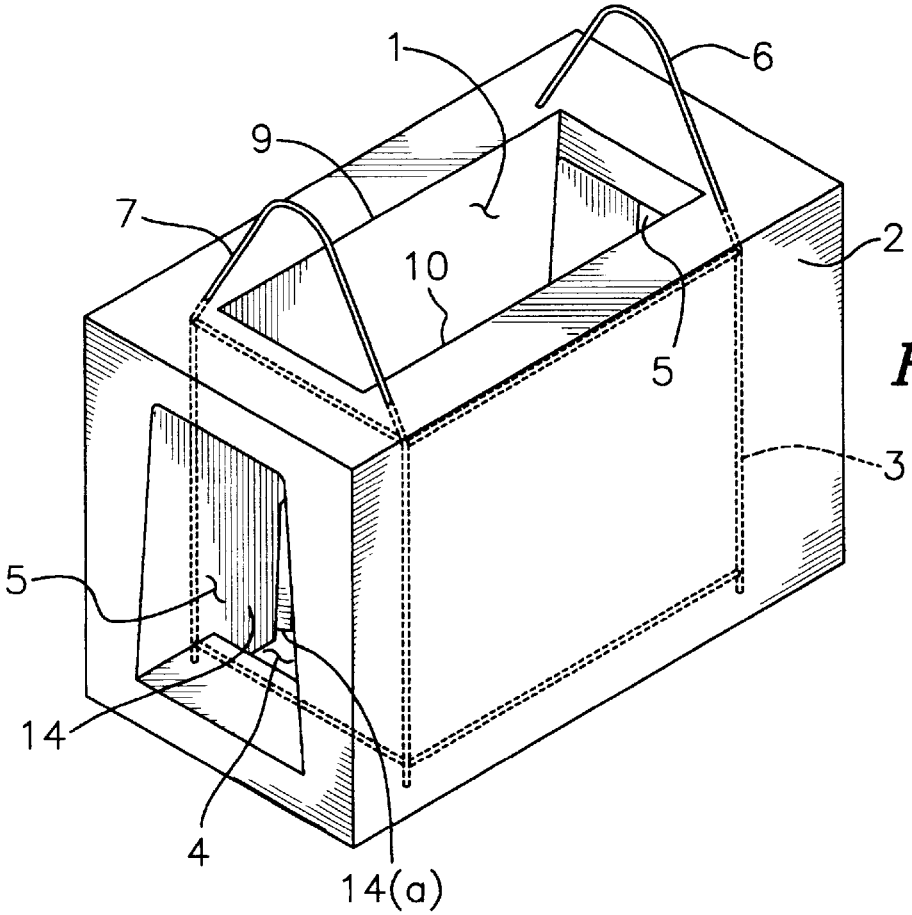
FIG. 1 is a plan view of one of the blocks described by the invention.

As can best be seen by FIG. 1, one invention comprises a specialized block having a special purpose for construction of a building. The blocks, can be understood by reference to FIG. 1 which shows a perspective view of a block utilizing the construction techniques set out herein. This block comprises a block top opening 1 and at least one block additional opening, here a bottom opening 4 and a side opening 5. At least a portion of the internal area of the block is hollow in order to provide a passage which allows the block top opening 1 to communicate with the block bottom opening 4 or side opening 5 or both.

Figure 13:
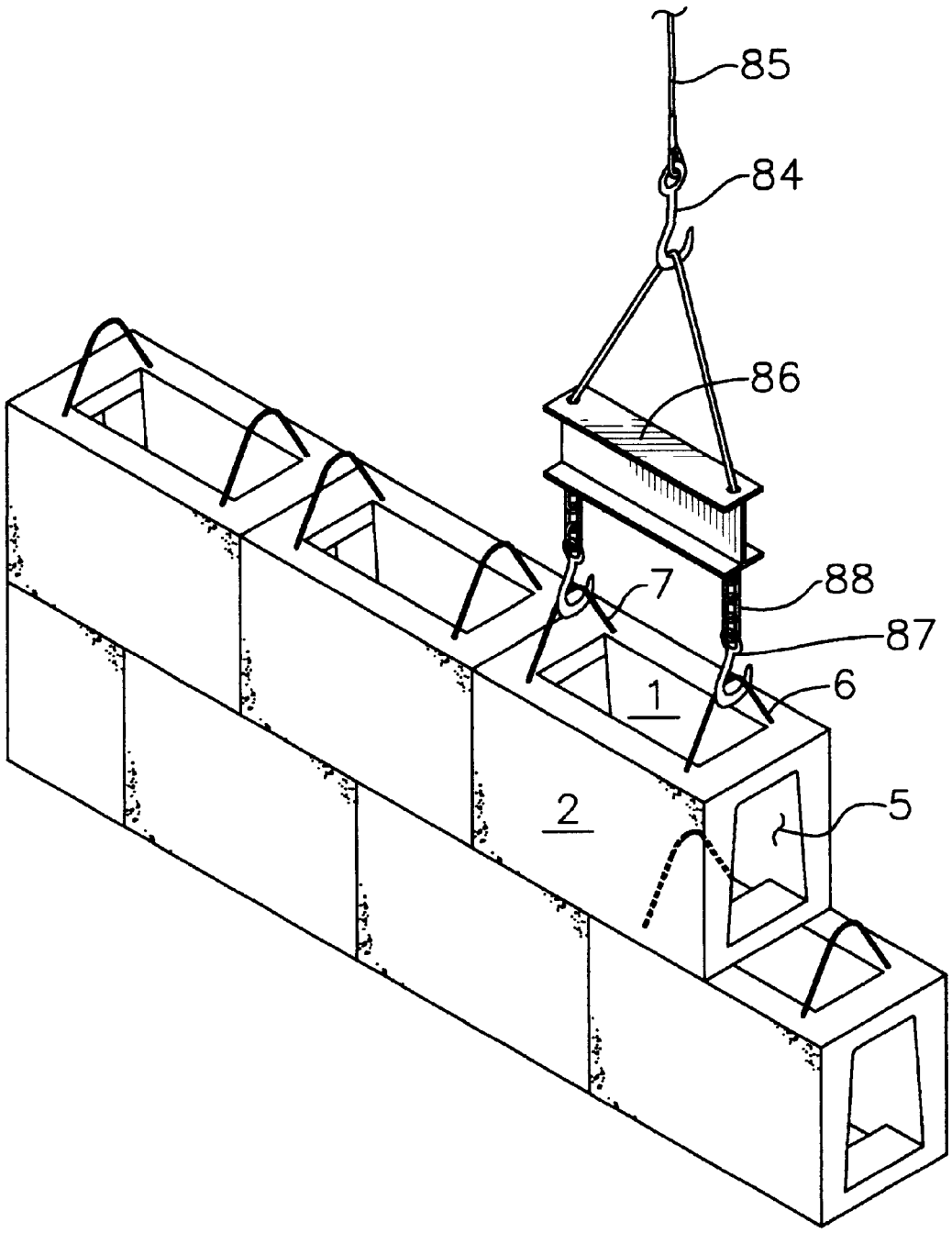
FIG. 13 shows a wall being assembled using the blocks described herein.

In the preferred embodiment the bottom opening 4 is larger than the top opening 1. The bottom opening 4 is large enough to receive first and second guide rods 6 and 7 respectively. The guide rods 6 may come up from the center of the top opening 1 or from the walls on either side of the top opening 1. The guide rods 6 are preferably curved at the top so that as a top block is lowered by its own guide rods 6 and 7 onto a lower block the bottom opening 4 of the top block accepts the guide rods 6 and 7 of the bottom block into the bottom opening 4 and the bottom edges 14 of the bottom opening 4 are guided by the guide rod 6 into the appropriate location. As a result, while only one guide rod is needed, at least a first guide rod 6 and a second guide rod 7 are present in the preferred embodiment for proper centering of a top block with a bottom block as shown in FIG. 13.

In the preferred embodiment, the bottom opening 4 is larger than the top opening 1 so that the guide rods will appropriately guide the bottom opening in place over a lower brick and also to make the concrete pours more even by preventing concrete build up within the pour. In addition. The edges 14 of the bottom opening 4 may be notched so that these notches 14(*a*) could be guided over the rods 6 and 7.

The spacing and use of the guide rods 6 and 7 defines how many are needed and what shapes are possible. The size of the rods is governed by the strength requirements since the rods serve a lifting purpose and a guiding purpose. In addition, the rods act as reinforcing rods when concrete is poured into the assembled blocks. The second guide rod 7 is shown here as being parallel to the first guide rod 6. However, it can easily be seen that it may be at an angle off parallel all the way to being perpendicular to form a dome for guiding a second block onto a first block.

In the preferred embodiment there are two rods for easy lifting and the rods travel from the left side 9 of the top opening 1 to the right side 10 of the top opening 1. Once one block is on top in line with another lower block (as shown in FIG. 13) concrete may be poured through the top block top opening 1 and then it travels through to other blocks which have openings aligned with this top block. Guide rods may extend from the side openings for a similar purpose although this is not necessary in the preferred embodiment given the function of the rods to allow for easy lifting and placement of the blocks.

Figure 2A:
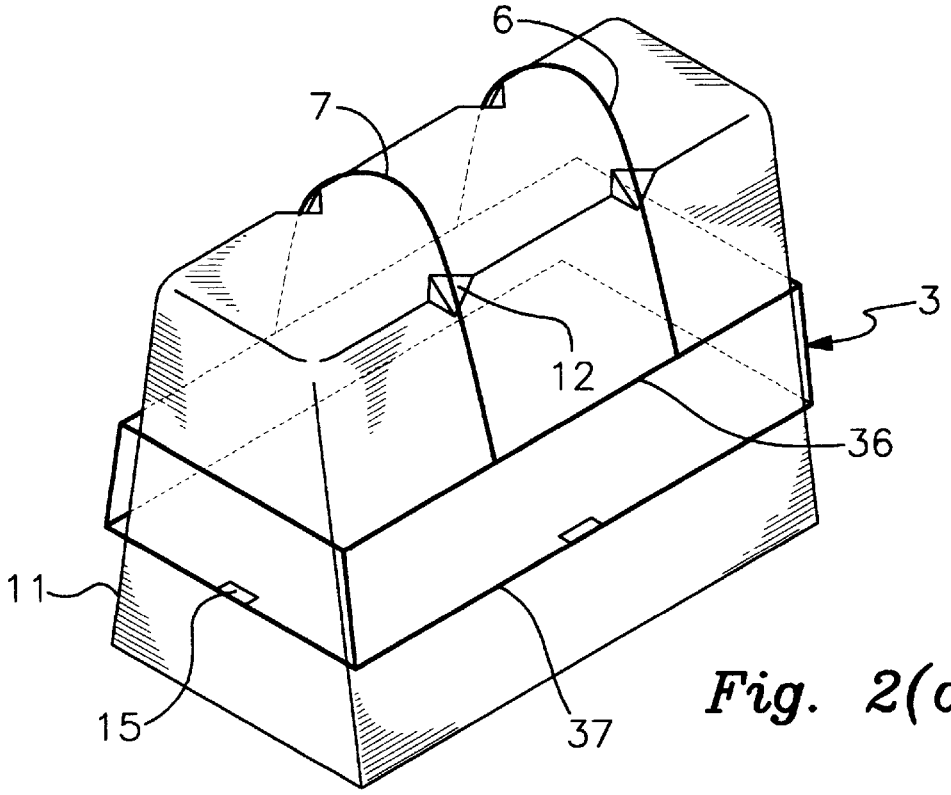
FIG. 2(*a*) is a plan view of a plug having a notched centering means and a cage mounted on the centering means with a single lifting rod.
Figure 6:
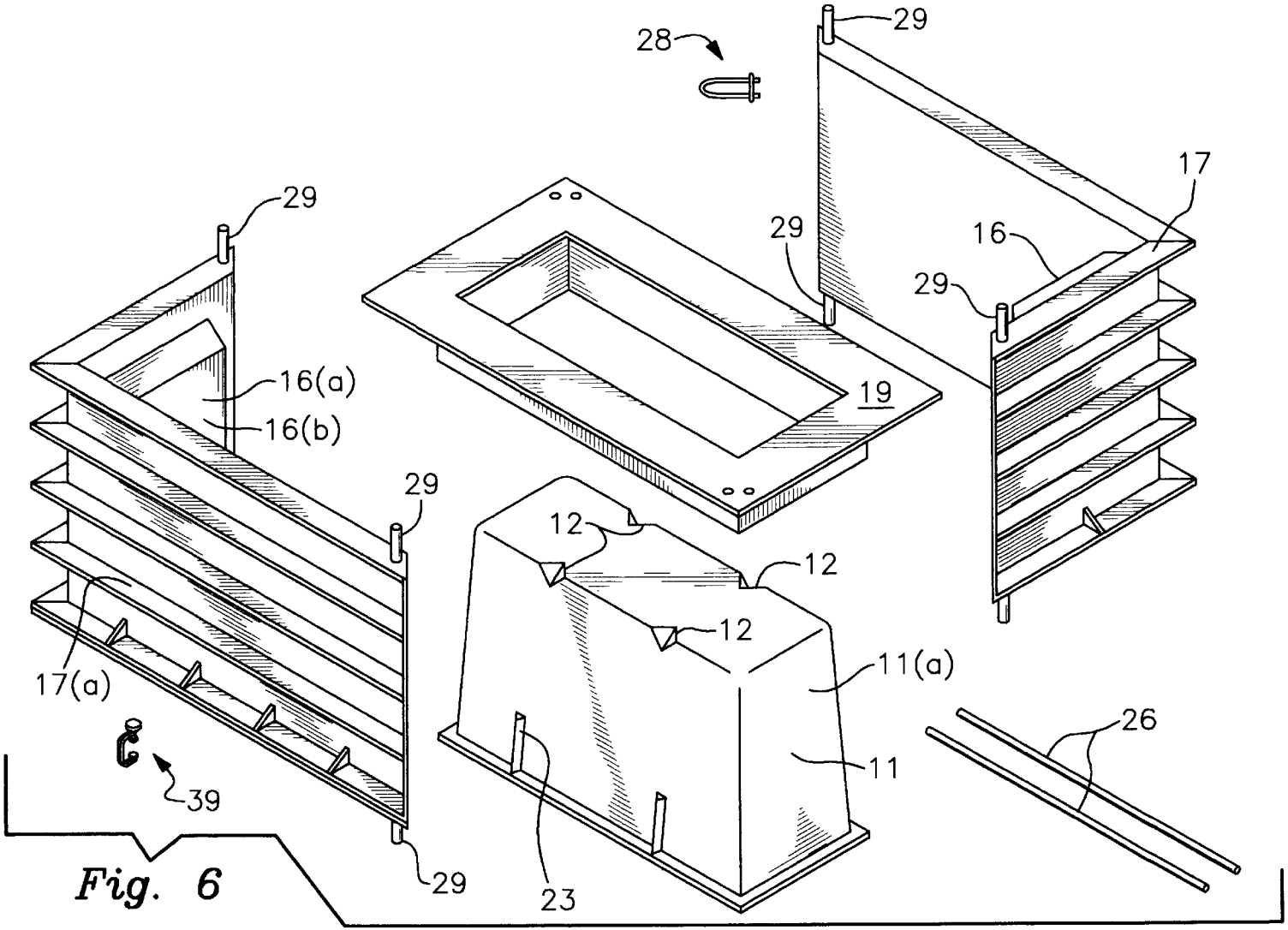
FIG. 6 is an exploded view of a mold used for making blocks.

As shown in FIG. 1 and 2(A), when two guide rods are used, they can come off the cage at different locations. One or more rods may be used. If one rod 6 were used, it would be preferably centered based on the weight of the block 2. Tabs or spacers 15 are attached to the cage, here at the bottom frame 37. The bottom legs of the cage extend past the bottom frame 37 to support the cage off the base 19 of the plug 11 as shown in FIG. 6.

As can be seen by reference to FIG. 2(A) the edges of the plug 11 are curved. In FIG. 2(A), when the cage is in place on the plug a portion of the guide rods lays on the notches 12 of the plug so that the cage is properly aligned. The cage side may have an upper and lower part running along the side of the plug.

Figure 2B:
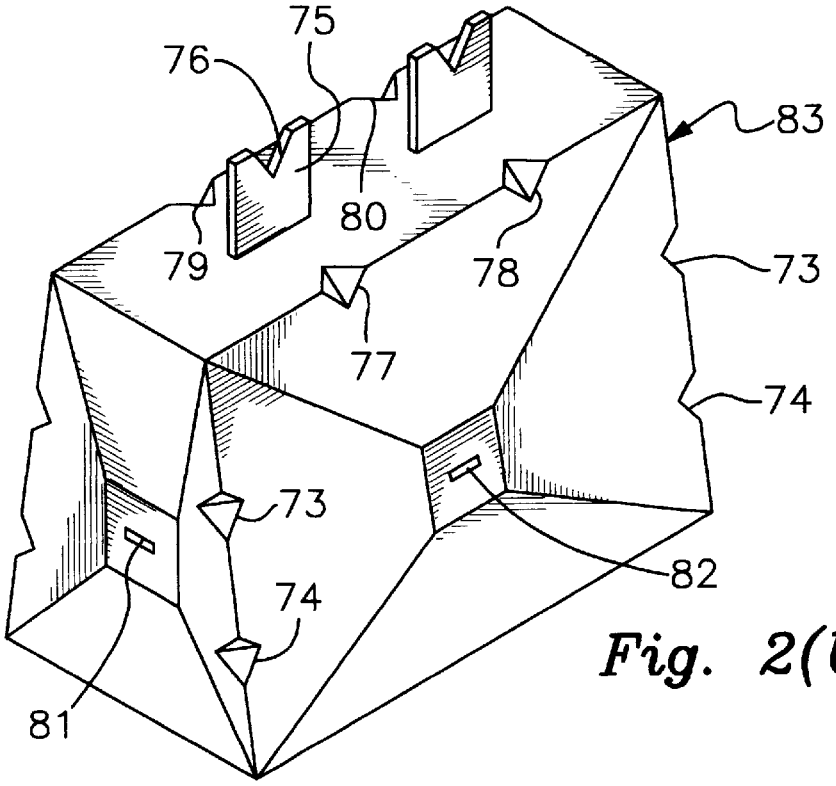

As shown in FIG. 2(B), the internal cage 3 may be built on a jig which has top notches 73 and bottom notches 74 to receive the top frame 36 and bottom frame 37 respectively. Since the rods 6 and 7 must extend over the top, raised guides 75 may be used to assure the proper height of the guide rods 6 and 7. The raised guides 75 may define raised notches 76 which receive the guide rods 6 and 7 as they are run from one side of the cage over the raised guides 75 to the other side of the cage. To further guide the placement of the rods 6 and 7, right side notches 77 and 78 and left side notches 79 and 80 are provided. Rod 6 is attached from the top frame 36, fit through right notch 78, into the nearer guide 75 within the notch 76, through the left notch 80 and back onto the far side of the top frame 36. This same design arrangement is provided for the other rod 7.

To provide proper placement of the tabs or spacers 15, short side spacer alignment 81 and long side spacer alignment 62 may be used to show where the spacer is to be inserted and to set the distance if the spacer 15 extends inward from the cage.

Figure 3:
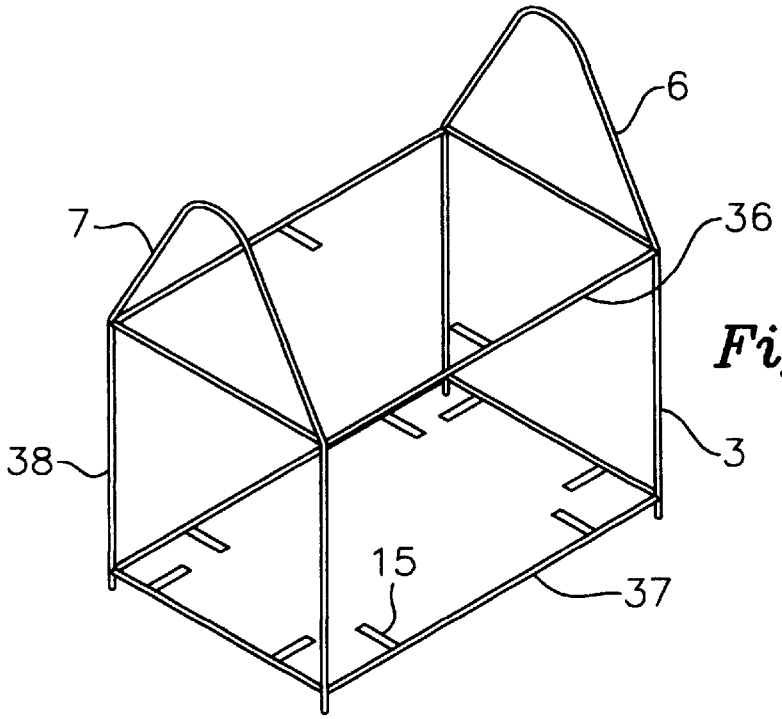
FIG. 3 is a plan view of a cage having lifting rods.

FIG. 3 shows the use of two rods 6 and 7. In order to allow the blocks to be lifted by the guide rods 6 and 7 an internal cage 3 is built within the block itself. Cross rods (not shown) may extend through the center of the block between sides of the internal cage 3 in order to add additional re-enforcing strength to the concrete poured within the blocks although this is typically unnecessary.

The use of spacers 15 as shown in FIG. 3 throughout the cage 3 allows the cage to be centered on plug 11 even without notches 12.

As shown in FIG. 3 the cage 3 is preferably comprised of a bottom frame 37, a side frame 38 and a top frame 36 formed of interlocking metal bars of sufficient thickness to support the blocks when lifted by support bars 6 and 7 when the block is lifted. While the support rods 6 and 7 are shown at either side, of the cage, their number and location is discretionary as long as they serve their guiding function, their re-enforcing function, and their lifting function.

The internal cage not only allows for the lifting and strengthening the position of the guide rods but also adds structural strength to the concrete block 1. The cage may be partially or completely encased in concrete although at least a portion of it is preferably encased in concrete so that the block may be lifted by the rods 6 and 7 extending from the cage 3.

In the pouring process, the cage may be suspended within the mold for the block. As shown in FIG. 2, the guide rod 6 may be centered on a notch 12 on a plug 11 to properly center the cage and this may also be done with spacers 15. Once in place and centered, concrete is poured into a mold as described in more detail below.

FIG. 6 shows the mold assembly. During assembly, a cage as shown in FIG. 2*a* or 3 is put in place before side plugs are installed. FIG. 6 shows the assembly of a mold for manufacturing blocks with bottom and side openings. The mold consists of a bottom plug 11 which is fitted within an opening in the base 19 of the mold. This bottom plug 11 will form the top opening 1 and bottom opening 4 if it fits all the way through the block. If only a top or bottom opening is desired, the plug will not pass all the way through. The cage 3 also shown in FIG. 3 is then put on top of this plug 11 and the side walls 17 and 17*a* are attached so that either of the side plugs 16 or 16*a* would touch the bottom plug 11, if it is desired to have either of the side openings 5 in the block. As is obvious, if there is only one side plug 16 or 16*a* there will be only one side opening. If there are no side plugs, there will be no side openings. If a side plug does not reach the bottom plug 11, there would be an indention, but no passage through the block.

If there is no bottom plug 11, but the left side plug 16*a* and right side plug 16 touch, there will be side openings, but no bottom opening. If a top plug is inserted into this arrangement, there would be a top opening and side opening, but no bottom opening. Likewise, if the bottom plug 11 does not reach the top of the mold, there will be a bottom opening, but no top opening. Specialized blocks for corners, bottoms and tops may thereby be formed.

In the preferred embodiment, both the bottom plug 11 and side plugs 16 are tapered from the base 19 or wall 17, respectively, to a more narrow end to make removal easier. Since the bottom plug 11 is tapered from a wide base to a narrow top, the top face 16*b* of the side plug 16*a* is tapered so as to fit against the side face 11*a* of the bottom plug 11. This fit leaves little or no concrete between the faces 16*a* and 11*a* or leaves a thin enough sheet of concrete so that it may be easily punched out. Assembly bars 26 are inserted through the base 19 below the bottom of the plug 11 to hold the plug 11 in place during the pour. These rods 26 will later be removed to allow the plug to be removed.

Ridges 23, shown in FIG. 6, along the side of the plug 11 result in notches 14*a* along the bottom edges 14 of the bottom opening 4 of the poured block 2 as shown in FIG. 1.

Figure 8:
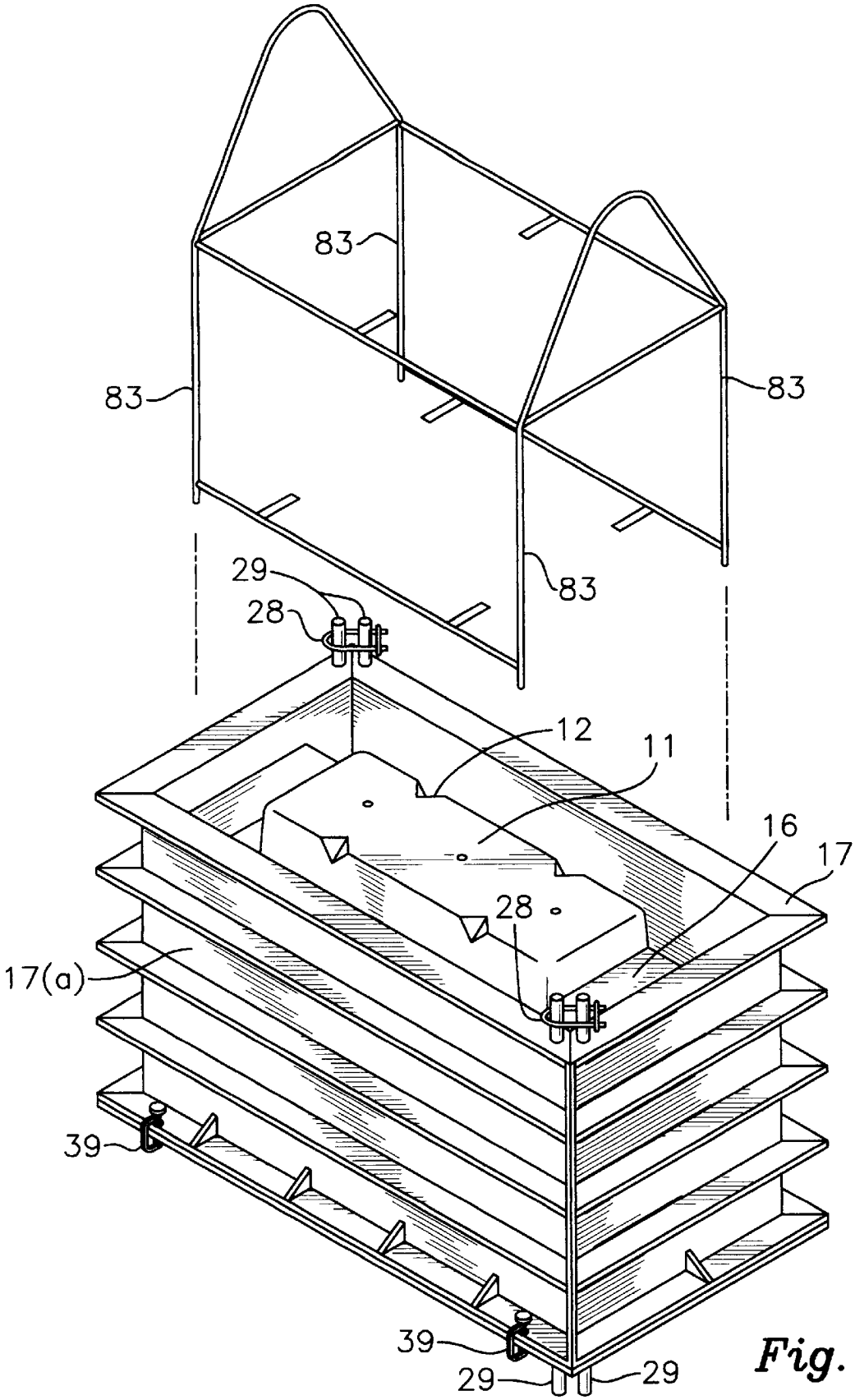
FIG. 8 shows an assembled mold with a modified cage.

As can best be seen by reference to FIG. 8, c-clamps 28 attached to posts 29 on each of the two separate side walls 17 and 17*a* of the mold serve to hold the side walls together relative to one another as the mold is poured. The base 19 is also held to the side walls 17 and 17*a* by way of clamps 39.

When the mold is assembled, as shown in FIG. 8, the concrete may be poured into the mold. If desired, the top may be trowled smooth, exposing a portion of the plug top or having a thin enough layer over the plug top that it may be punched out. FIG. 8 shows the internal cage out of the assembled mold, but as discussed above, referring to FIG. 6, typically the cage would be put in before any side plugs 16. Here, in FIG. 8, the bottom of the cage 3 is open on the side. The side legs 83 can fit on either side of the side wall plugs 16 and 16(*a*) shown in FIG. 8.

It can be seen that if the side plugs 16 were to meet in the center without a bottom plug 11, the cage 3 could fit over the side plugs 16. This would form a lifting rod over block which had a passage which was below but not affected by the lifting rods. The lifting rods would still serve their lifting function. They would also serve their reinforcing function if a second block with a bottom opening were placed over the lifting rods.

After the plugs, walls and cage are assembled, concrete can be poured and the entire mold allowed to cure, fully or partially, at which point the plugs are pulled, pressed or knocked out and the block is ready to use.

The ridges 23 which may rise from the bottom plug 11 to provide guides in the finished block which receive the support bars 6 and 7 shown in FIG. 3 when one block is placed atop another. The blocks may be of a variety of shapes without departing from the concept embodied herein.

After an appropriate amount of drying, the plugs 11 are then drawn out or pressed out or knocked out of the center of the block. The plugs 11 may have notches 12 which allow for them to assist in the alignment of the cage 3. The edges 13 of the plug 11 are rounded and the sides 16 of the plug are tapered in order to assist with the plug's removal. Tapering also leads to the larger size of the bottom of the block opening versus the top block opening 1.

Figure 9:
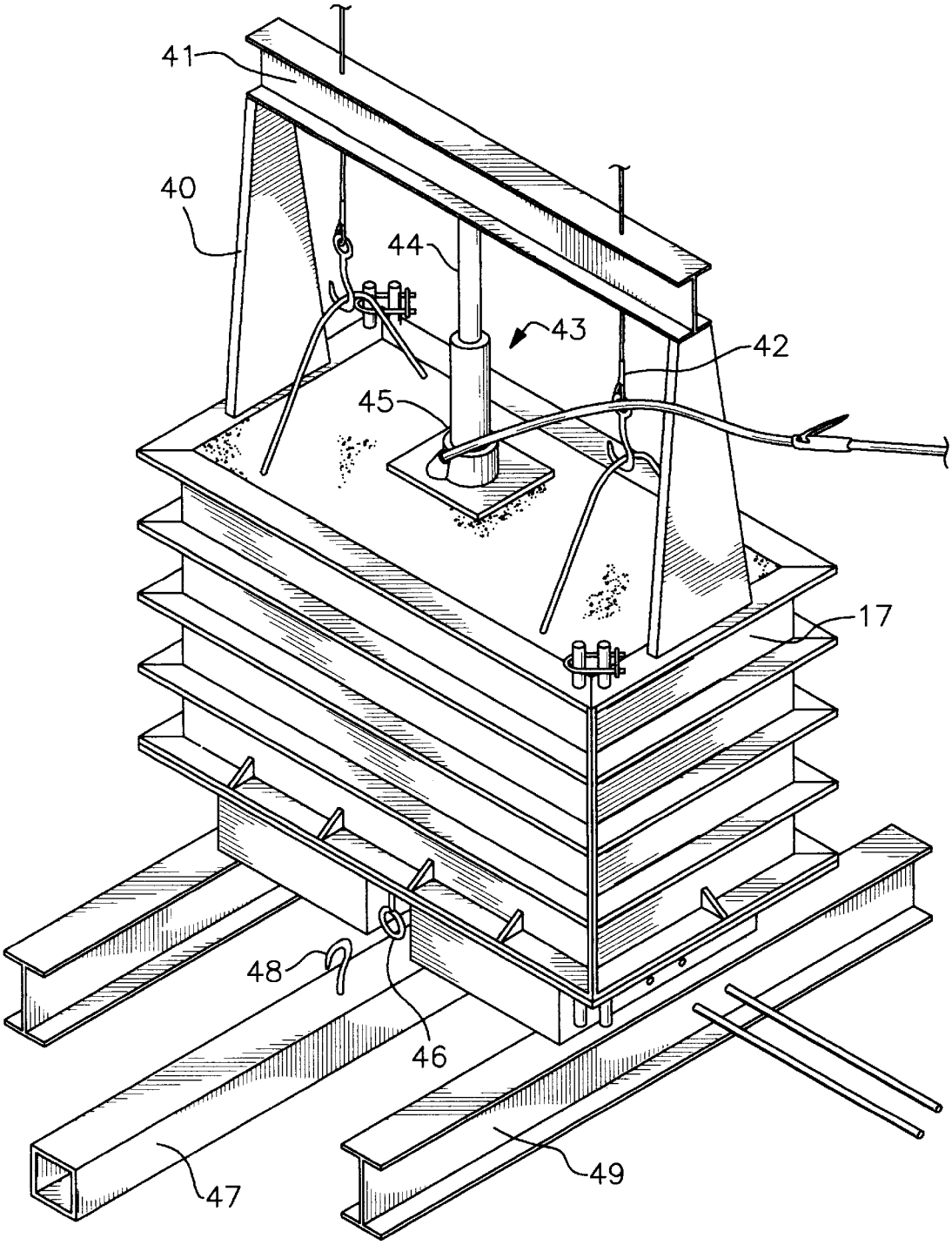
FIG. 9 shows a press and pull mechanism for removing plugs from set pours in the mold.

As can best be seen by reference to FIG. 9, after a block is produced within the mold, the plug 11 may be removed by jacking the plug 11 out or by pulling the plug out from the bottom or a combination of the two techniques. This may be done while the concrete is fully hardened or during the drying process when the mold is sufficiently set in order to allow the passages defined by the plugs to remain in place. There may be small holes in the plugs which receive pins to test the concrete for drying. In FIG. 9 it can be seen that brace supports 40 support a brace 41 against the sides of the mold. The brace 41 is also supported against the jack arm 44 by chains 42 hooked into the guiding rods 6 and 7 of the block. A jack is inserted between the plug 11 and the brace 41 and as the jack arm 44 pushes against the brace 41, the jack base 45 pushes the plug 11 out.

FIG. 9 also shows the use of a eye-bolt 46 built into the bottom of the plug 11. This eye-bolt 46 may be attached to a hook 48 on a beam 47. This arrangement is held off the floor by placing the mold on I-beams 49 and the beam 47 is pressed to the floor, pulling the plug 11 from the mold. These same technologies may be used on the side plugs which are smaller and require less stress to remove.

Figure 4A:
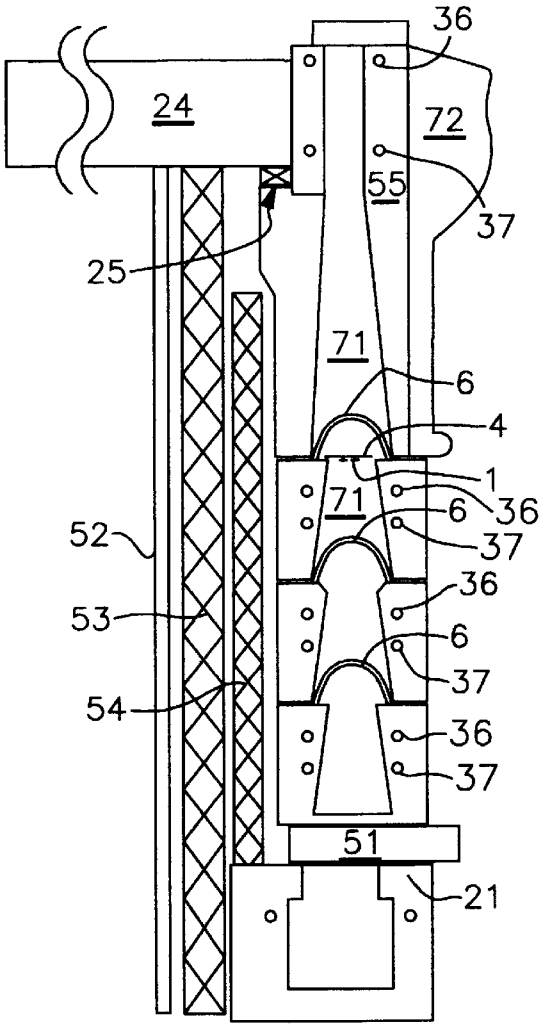
FIG. 4*a* is a cross section of the detail shown in FIG. 4 through the 4*a*—4*a* axis.
Figure 4:
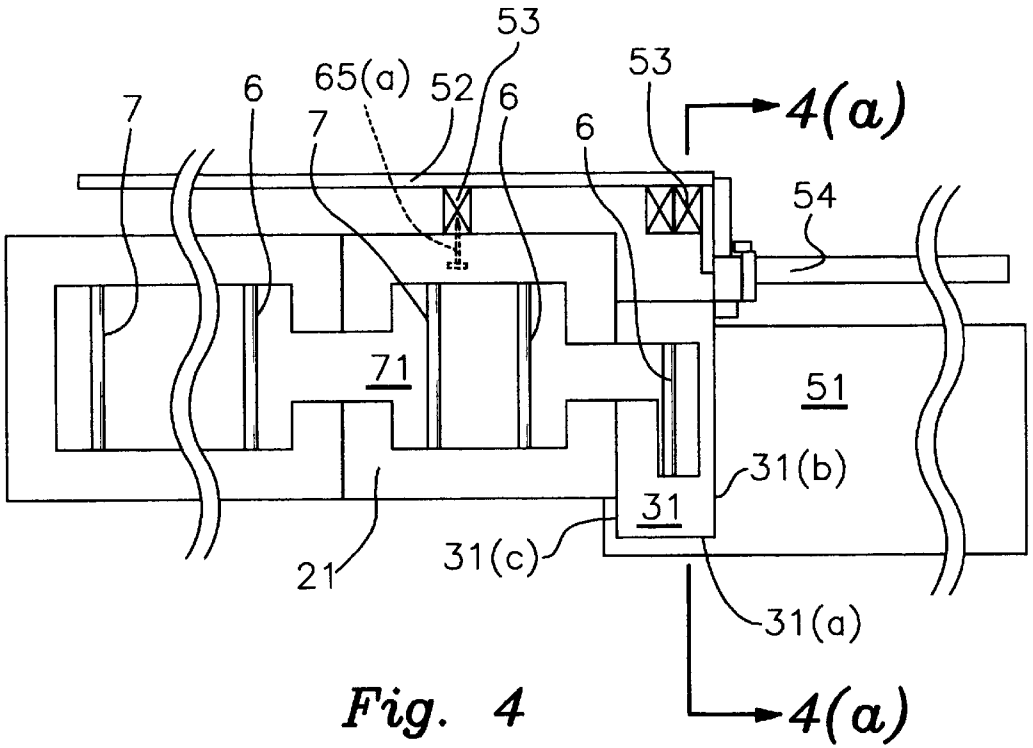
FIG. 4 is a cut away view of a structural wall detail, here a window frame, of the type shown in FIG. 5 through the 4—4 axis of FIG. 5.

FIG. 4 shows the use of traditional framing on offsets created by the construction techniques utilized herein. Here, 8 inch wide [0.203 m] frame blocks 31 extend around the window 50. As seen looking down in cross section, 4—4, shown in FIG. 4, the 8 inch [0.203 m] frame blocks 31 are offset to stick out from the 16 inch [0.406 m] structural blocks 21 by a predetermined distance 31(*c*). The front face 31(*a*) of the blocks facing outward may be slightly less far out than the cast sill 51 on which the 8 inch [0.203 m] frame blocks 31 and window 50 rest. The actual window 50 is recessed from the front face 31(*a*) of the 8 inch [0.203 m] frame blocks 31. In this embodiment, the interior walls 52 are mounted on studs 53 in the manner well known in the art. The window is recessed within the walls by a window casing 54 of the type also known in the art.

By way of example, the 8 inch [0.203 m] frame blocks 31 abut the 16 inch [0.406 m] structural blocks 21 which are here thirty inches [0.762 m] long and the frame blocks 31 may be indented within the 8 inch difference [0.203 m]. The side openings of the frame blocks 31 and structural blocks 21 would preferably be aligned as shown in FIG. 4 even though the blocks themselves are of different widths.

Figure 5:
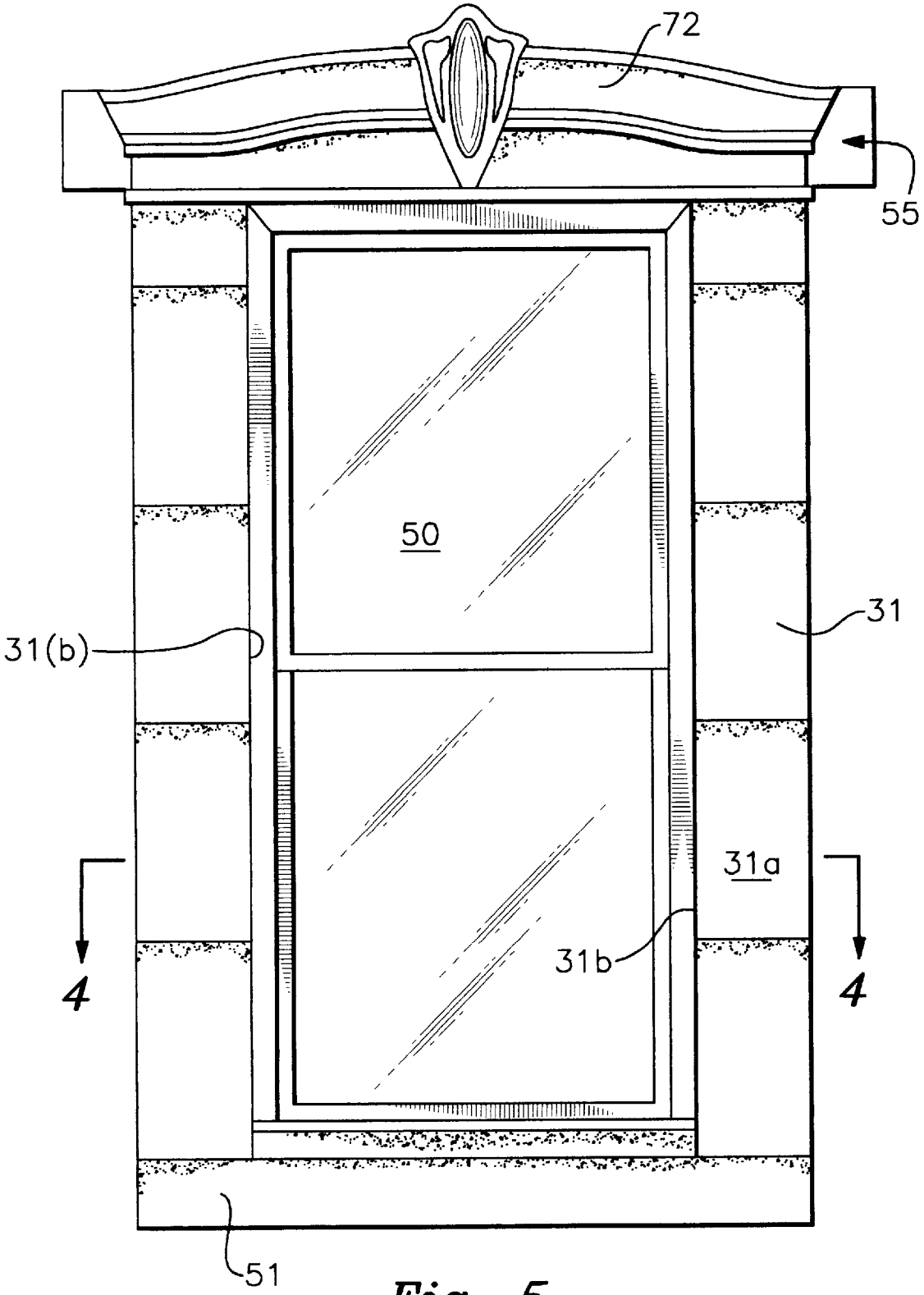
FIG. 5 is a window frame incorporating the structure described herein.

As shown in FIG. 5, a solid cast cornice or lintel 55 may be placed atop the window frame described by the 8 inch [0.203 m] frame blocks 31. This cornice 40 would be supported by and integral with the 8 inch [0.203 m] frame blocks.

FIG. 4(*a*) shows a side section of the cross section shown in FIG. 4. Several benefits of the blocks described above are apparent from this figure. Referring to the top block, lintel 55 of the window treatment which is shown in this FIG. 4(*a*), it can be seen that structural and design details may be incorporated into a poured block. The structural detail here is a plate 25 which receives a beam 24 atop a wooden wall stud 53 which rests on the plate 25. The plate is a part of the poured block. In addition, this lintel block 55 incorporates a design exterior treatment 72. While both the plate 25 and exterior treatment 72 are shown here in a single block, it is obvious that either detail may be incorporated into a block without the other.

Figure 10:
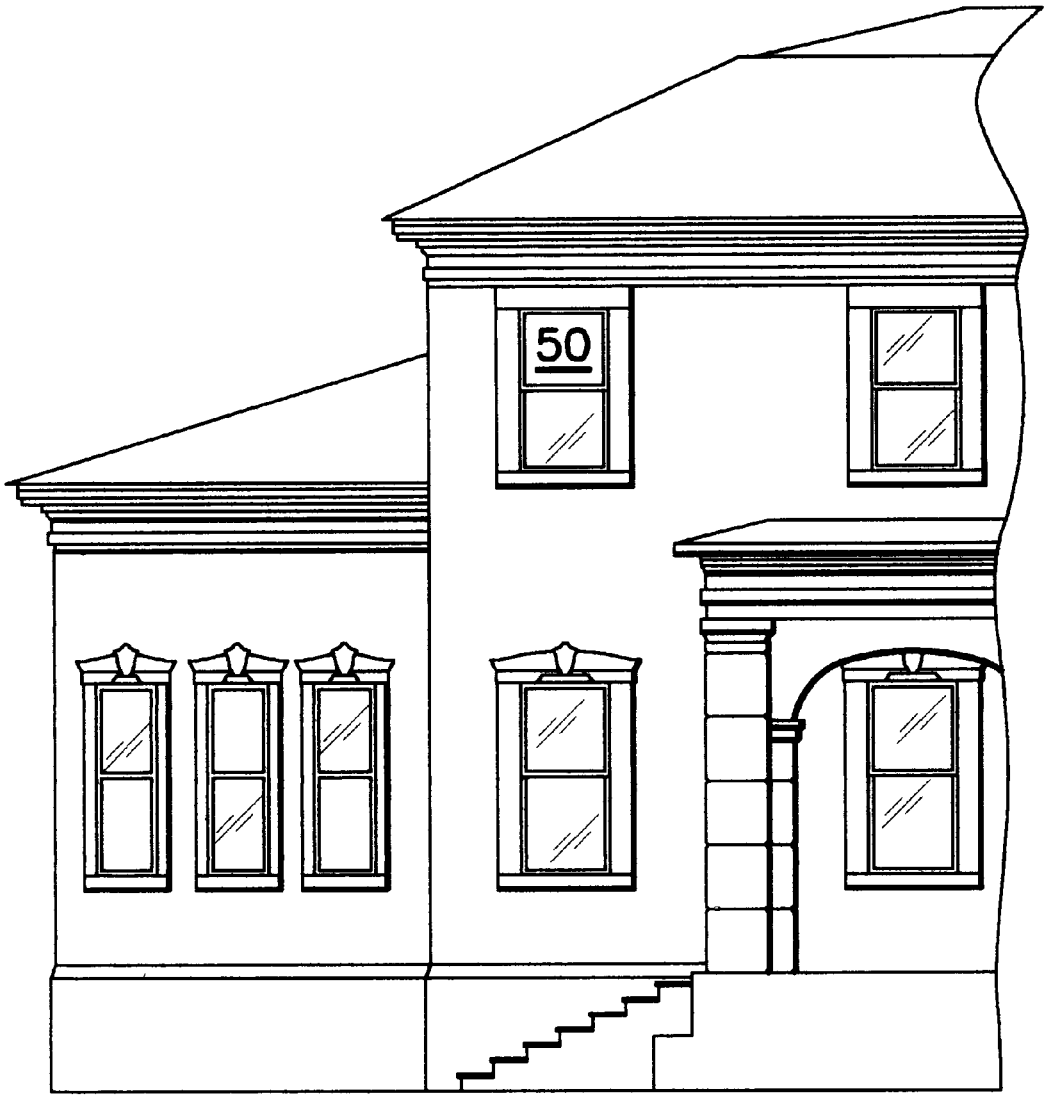
FIG. 10 shows a plan view of the structure described in FIG. 7.

Architectural details are shown in FIGS. 4, 5 and 10 for an exterior window 50. The casing for the window 50 is built onto special blocks set as shown in FIG. 11 among the remaining framework.

Figure 11:
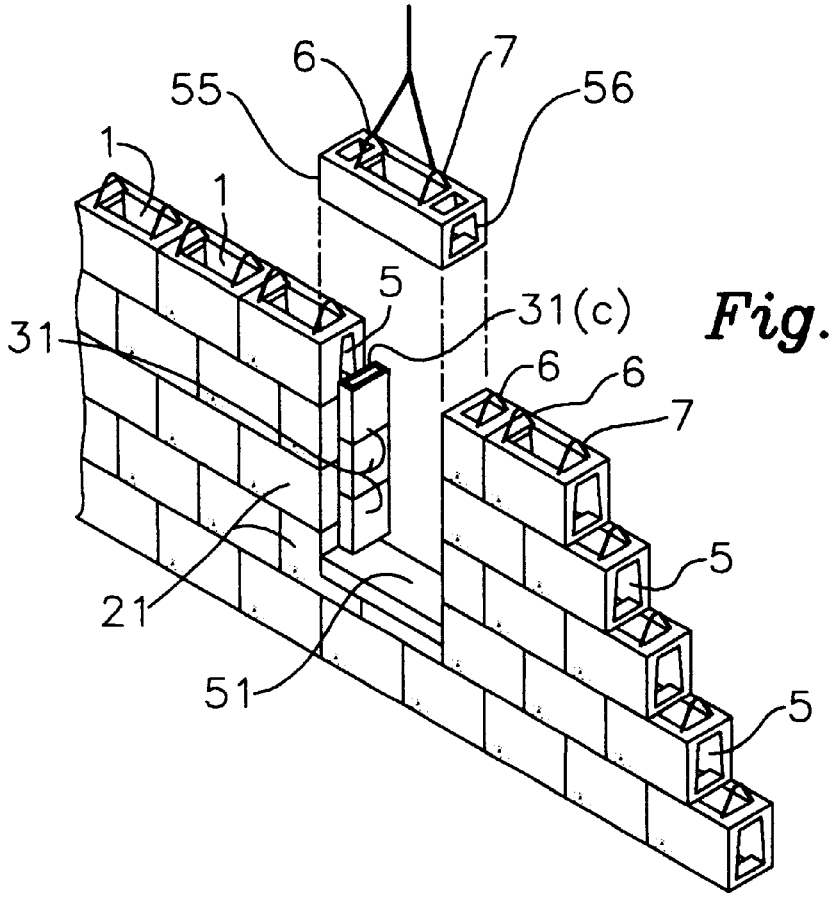
FIG. 11 shows an architectural detail of a window, such as is shown in FIG. 5, during the assembly process.

FIG. 11 shows how the window treatment described in FIGS. 4 and 5 would be assembled with a lintel 55 which, here, has neither a special exterior treatment nor a plate. Here, the 8-inch [0.203 m] frame blocks 31 are in place and the lintel 55 is being lowered by way of the support rods 6 and 7. A side opening 56 in the lintel may allow concrete to connect the lintel 55 to the 16 inch blocks on either side which would have cooperating openings. The lintel 55 may also have bottom openings (not shown) to allow concrete coming into the lintel's interior through lintel top openings 57 or side openings 56 to move into the top openings in the top most 8-inch [0.203 m] frame block. From there, the concrete would pass into the lower 8-inch [0.203 m] frame blocks sealing the structure together. Alternatively, after concrete has been poured into the 8-inch [0.203 m] frame blocks, the lintel 55 may be placed on top.

Figure 12:
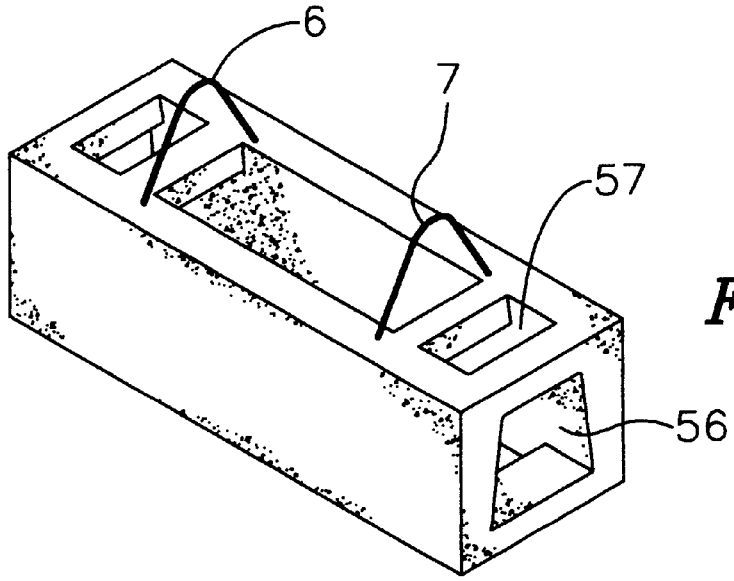
FIG. 12 shows a lintel block used in the construction of the window shown in FIG. 11.

As the lintel 55 shows in FIG. 12 and 11, there may be multiple top openings 57 to allow pours down the left and right 8-inch [0.203 m] frame blocks 31. Similarly, there would be corresponding multiple bottom openings 4 (not shown) to allow the concrete to flow through to top openings in the 8-inch [0.203 m] frame blocks 31 below the top openings 57.

FIG. 12 shows a detailed view of the lintel 55 shown in FIG. 11.

Figure 7:
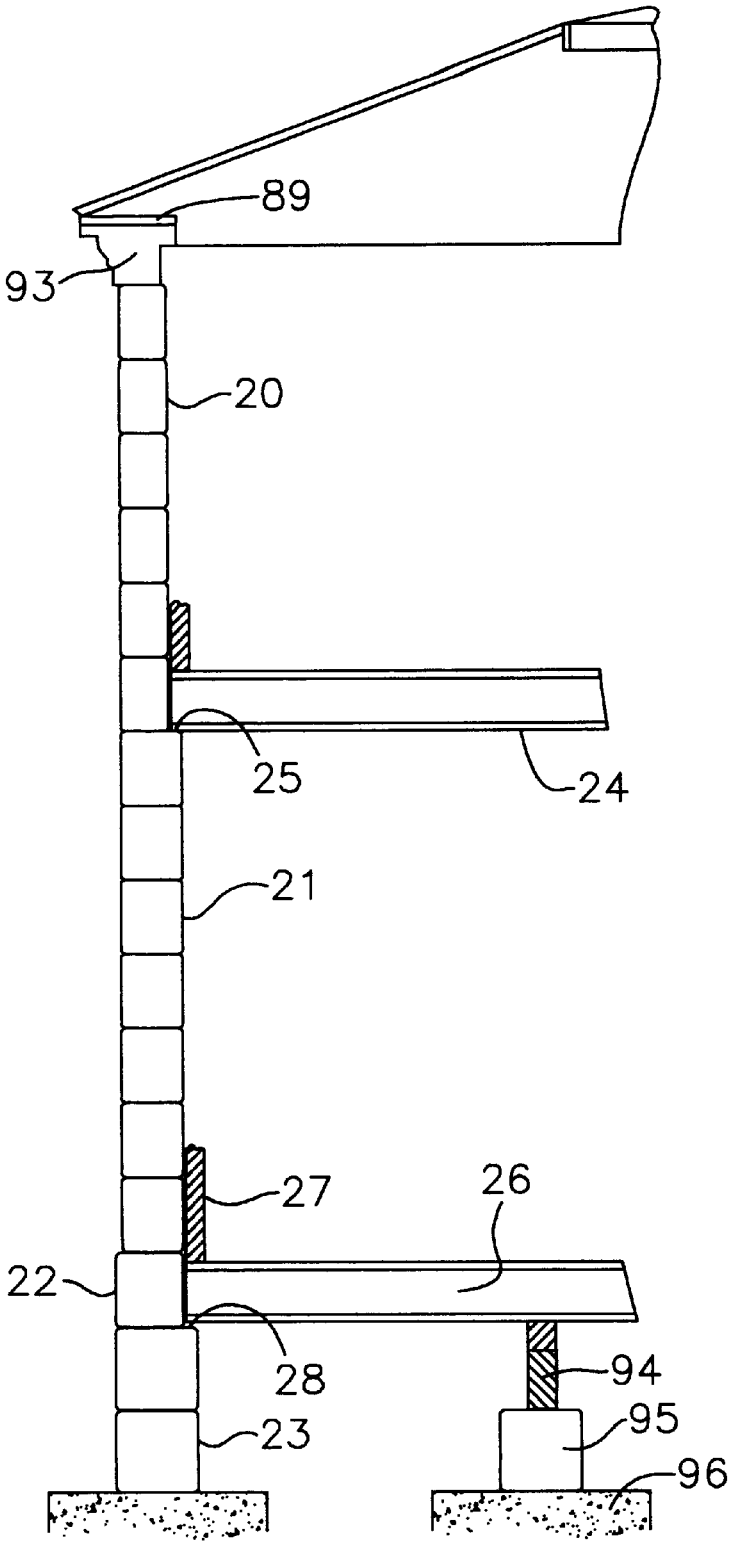
FIG. 7 is a cross sectional view of a wall in a two story structure using the technology described herein.

FIG. 7 shows a side cross section of a house where a series of blocks as shown in FIG. 1 are stacked one on top of the other and as can be seen here 12-inch [0.305 m] small blocks 20 may have holes bottom holes in alignment, not only with each other, but also with 16-inch [0.406 m] structural blocks 21 by virtue of having the location of the plug off center during their formation in order to allow for the placement of a joist 24 on a plate 25 atop the 16-inch [0.406 m] structural block 21. This plate 25 is the area the larger 16-inch [0.406 m] structural blocks 21 which is not covered by the smaller 12-inch [0.305 m] small blocks 20. This is compared with the formed plate 25 which is an integral part of the top block 55 shown in FIG. 4(*a*).

A similar arrangement is present where 16-inch [0.406 m] structural blocks 21 are aligned with 18-inch [0.457 m] middle blocks 22 to allow for two by four wall lumber 27 to be run off of a sixteen inch [0.406 m] I-Joist 26 which in turn rests on a plate 28 which is the uncovered area of the 22-inch [0.559 m] bottom block 23 when the 18-inch [0.457 m] middle block 22 is placed on the larger block as shown in FIG. 7. Similar to the offset of the 12-inch [0.305 m] small blocks, the 16-inch [0.406 m] structural blocks and 18-inch [0.457 m] middle blocks 22 may have bottom openings 4 which are offset so as to be aligned with the top openings on 22-inch [0.559 m] bottom blocks 23 and may define an offset 28 on which to place a joist 26 to support the construction within the walls so described. The purpose being to incorporate the architectural details into the blocks, rather than to attach these details at a latter point in time.

FIG. 7 also shows how the blocks may be built directly off of the foundation 96 or how a intermediary foundation block 95 may be placed on the foundation 96 which in turn supports seals 94.

FIG. 13 shows several blocks being stacked together utilizing the method taught hereunder, utilizing a crane (not shown) to lower blocks via a hook 84 and chain 85 attached to a small spacing beam 86 which is attached by two second hooks 87 and support chains 88 attached to the block support rods 6 and 7. It can be seen that the blocks may be offset to provide a more interwoven structural cross section.

Figure 14:
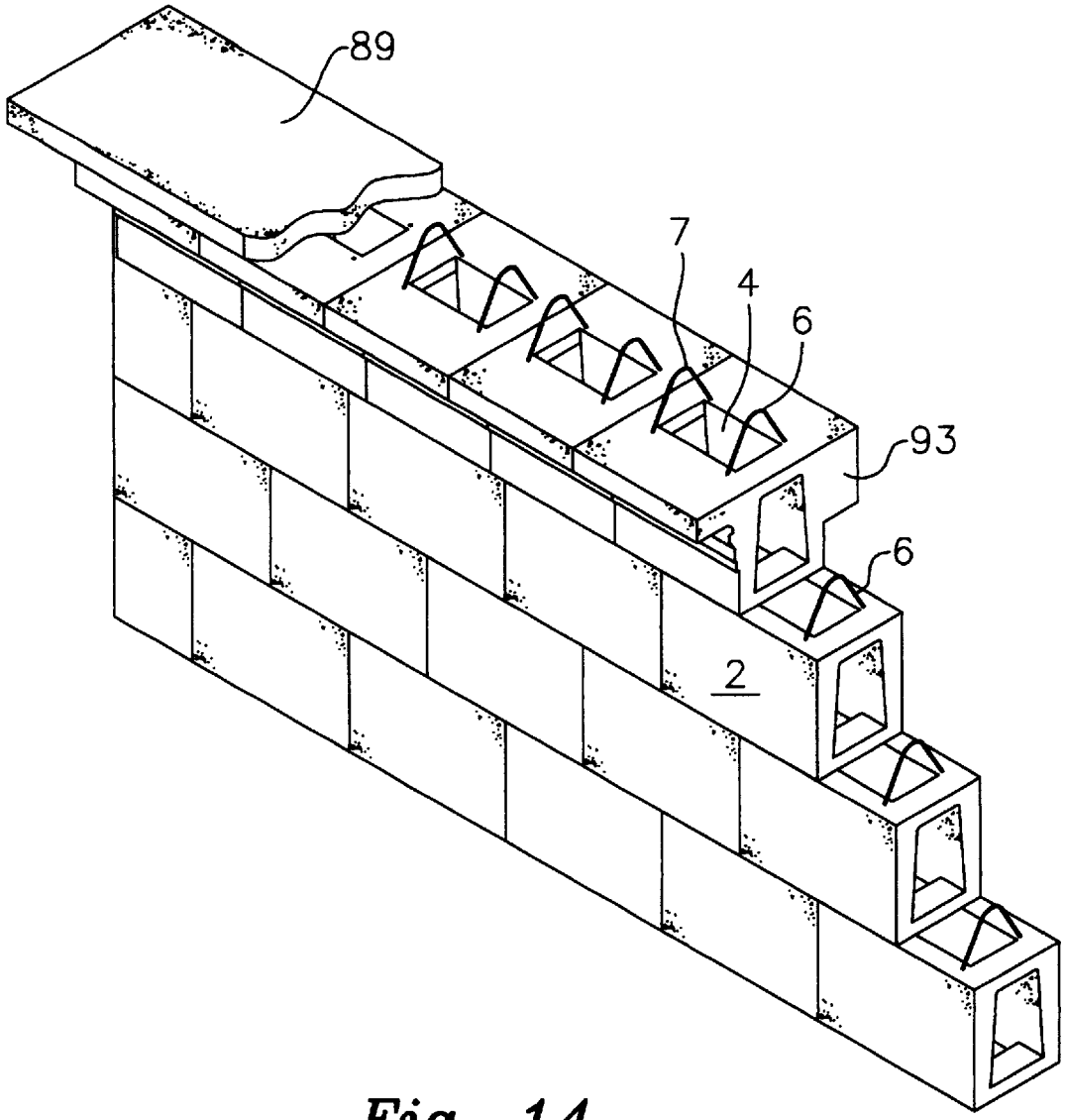
FIG. 14 shows the wall of FIG. 13 with a cornice and top plate.

FIG. 14 shows the wall of FIG. 13 with a top plate where several of the lifting bars 6 and 7 have been removed. FIG. 14 shows the top treatment for a row of blocks, such as that shown in FIG. 13. In this case, a group of cornice blocks 93, of similar construction, but having built in architectural details (a decorative overhang here) is placed atop the row of twelve inch blocks 20. Concrete may be poured through the openings in this top after the cornice support rods 6 and 7 are cut from the top of the cornice blocks. In this way, a flat surface is presented. Bolts may be set in the concrete pour and a top plate 89, of wood or metal, may be bolted to these bolts to allow for greater ease of building off of the cornice blocks 93.

Figure 15:
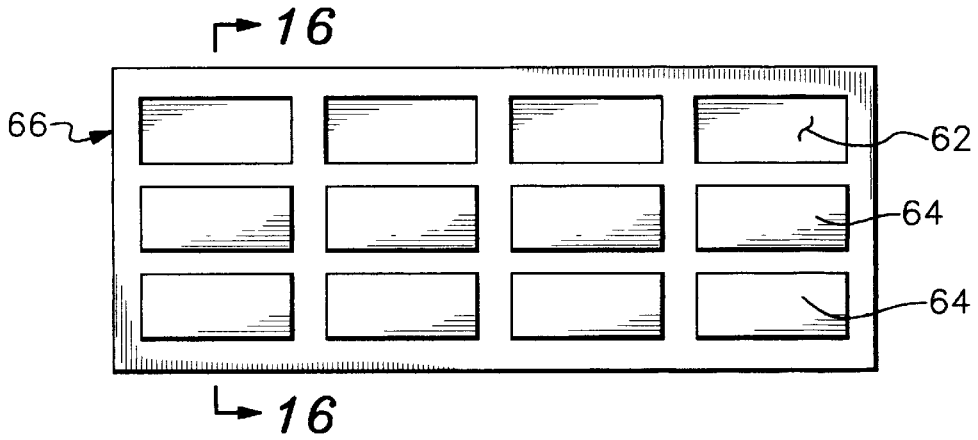
FIG. 15 shows an interior view of a mold wall detail.
Figure 16:
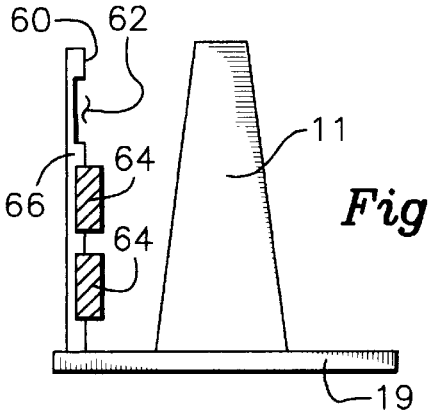
FIG. 16 shows a cross section of the wall detail of FIG. 15 through the 16—16 axis.

The interior walls of the molds may be modified in order to provide enhanced architectural detail or to provide for anchor bolts for interior finishes. As can best be seen by reference to FIGS. 15 and 16, the interior surface 60 of the outside mold wall 66 defines block openings 62. These block openings 62 may receive brick facing 64 or may be left empty to give texture to the block exterior face 68, shown in FIG. 19. The interior surface 60 faces the outside surface of the exterior face 68 of a block 69 to be made within the mold. The end product is a block such as that shown in FIG. 19. Hence, a finish may be applied to the exterior blocks by virtue of embedding a finishing material through this method or by imparting a finished texture. While a brick texture is shown here, any number of different textures could be encompassed by this technique including a vinyl or wood type finish which may be painted to look more like the final finished product. The key being to either (a) embed the finish material within the block by putting it in the mold or (b) texture the exterior of the wall by having the finish on the interior wall of the mold. The finishing means is either an exterior texture or a plurality of finish pieces (here brick or wood studs) where the finish pieces have an exposed side and an embedded side where the embedded side is within the block itself so that the finish pieces are partially embedded within the block and partially exposed from the block.

Figure 19:
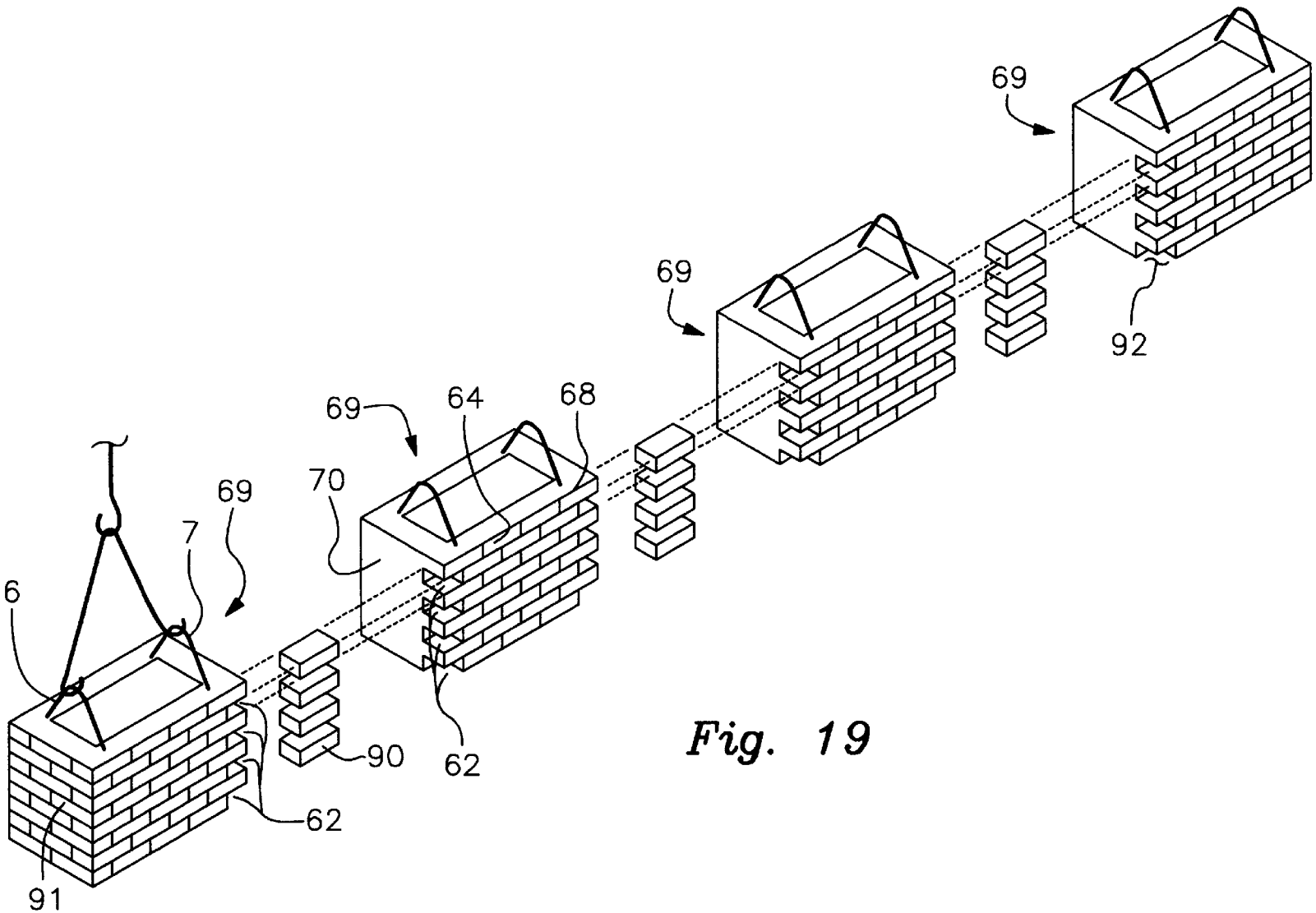
FIG. 19 shows a block wall produced using a mold detail such as that shown in FIG. 15.

As shown in FIG. 19, there may be a continuous wall formed with this brick pattern, joined, as shown here, by intermediary blocks 90 and cornered by a corner block 91. Gaps 92 have been left in this embodiment by the mold into which these intermediary blocks 90 may be fit.

Figure 18A:
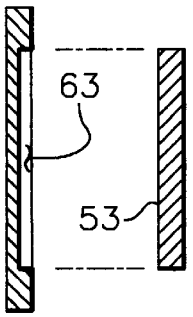
FIG. 18*a* shows a cross section of the mold wall detail of FIG. 17 through the 18*a*—18*a* axis using short studs as an attachment means.
Figure 17:
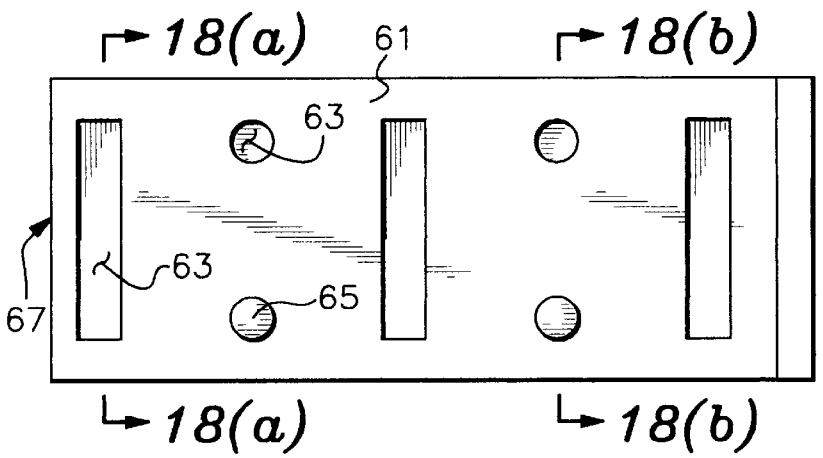
FIG. 17 shows an interior view of an alternative mold wall detail.
Figure 18B:
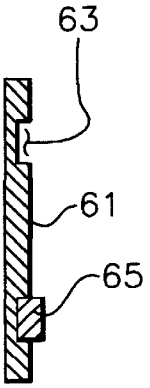
FIG. 18*b* shows a cross section of the mold wall detail of FIG. 17 through the 18*b*—18*b* axis using a long stud as an attachment means

This same technique may be used, as shown in FIGS. 17 and 18*a* and 18*b* for attaching mounting studs 65. Mounting studs as used herein refers to wooden studs, wooden pegs, embedded nails or even bolts 65*a*, as shown in FIG. 4 within the concrete matrix for mounting a finish to the exterior or interior surfaces of the finished blocks. These mounting studs 65 are inserted within openings 63 at predetermined points on the interior surface 61 of the inner mold wall 67. The inner face 61 of the interior mold wall 67 corresponds to the interior face 70 of the block 2. It is the part of block 2 which faces the interior of the building and where studs are attached. As shown in FIG. 18(*a*), full length studs may be used which could be aligned with studs in the block below. As shown in FIG. 18(*b*) the studs 65 or bolts 65(*a*) as shown in FIG. 4 may be much smaller and less obtrusive. The bolts 65(*a*) may be nails and may be set against a plate of wood or metal to cushion a blow which would be received when the interior wall is attached. It is also taught that the exterior treatment may be attached to similarly placed studs on this exterior surface were that desirable merely by having an exterior mold wall which was constructed in the manner taught hereunder for interior mold walls.

Since the arrangement, depth, shape and number of the openings 63 may be varied in an infinite variety, an infinite variety of finishes may be given to the exterior of the concrete where studs or bricks are placed within these openings 63 or where different finishing materials are placed within these openings 63.

As shown in FIG. 4, the wide portion of the retaining bolt 65*a* which is embedded within the concrete when the block is poured may be wider than the exposed end. This is also true if mounting studs 65 are used. While here the mounting studs 65 are round, they may be of any shape and may extend any length along the blocks. In this way, the mounting blocks 65 may extend down the block and join with the next lower blocks mounting studs to form a continuous stud for mounting interior or exterior wall treatments (sheet rock, brick, etc.). An example of this is shown in FIG. 4 where a wooden stud is attached by way of a bolt into the brick. If the stud was instead incorporated into the poured mold, the same effect would be realized.

During the concrete, mixing stage, the concrete or the concrete which makes the facade, may be mixed with a concrete dye to give it the appearance of stone or to enhance its appearance as brick. Hence architectural details may be a brick facade designed into the mold or it may be a cornice 93 or window treatment 72 such as is shown in FIG. 14 and FIG. 4(*a*), respectively.

Because many varying and different embodiments may be made within the scope of the inventive concept herein taught and because many modifications may be made in the embodiment(s) herein detailed in accordance with the descriptive requirements of the law, it is to be understood that the details herein are to be interpreted as illustrative and not in a limiting sense.

I claim:

1. An architectural block for use with at least one second block having a second block opening comprising;

(A) a top and a bottom, and further comprising a first side, a second side, a third side and a fourth side and said sides, top and bottom defining an enclosure which enclosure defines at least one first block opening which is continuous with a passage through the block which passage is continuous with at least one second block opening in the second block when the second block is placed against the architectural block, said architectural block further comprising:

(B) at least one first guide rod extending from within the first side to within the second side and across the at least one first block opening and wherein the at least one first guide rod is further described as extending above the top of the block.

2. The block of claim 1 further comprising at least one outside face, at least a portion of said outside face being in the shape of an architectural detail.

3. The block of claim 1 further comprising a lip facing the block top for receiving cross bracing.

4. The architectural block of claim 1 wherein the second block describe at least one groove adjacent to the bottom opening so that when the at least one first guide rod is inserted within the groove, the second block bottom opening is aligned with the at least one first opening in the architectural block.

5. The architectural block of claim 1 further comprising at least one cage having a first side frame member within the first side of the block and a second side frame member within the second side of the block and wherein the cage further comprises an attachment rod connecting the first side frame member to the second side frame member and wherein the at least one first guide rod has a left side and a right side and wherein the left side of the first guide rod is attached to the first side frame member and the right side is attached to the second side frame member.

6. The architectural block of claim 5 wherein the cage further comprises at least one reinforcing member extending from the first side frame member into the block passage.

7. The architectural block of claim 5 wherein the cage further comprises at least one reinforcing member passing from the first side frame member through the third side and then connecting to the second frame member.

8. The architectural block of claim 1 wherein the at least one first guide rod has a length between the first side and the second side and where the at least one first block opening is located at the block top.

9. The architectural block of claim 8 wherein the at least one second block has a bottom and wherein the second block opening is an opening in the bottom having a bottom diameter and wherein the length of the at least one guide rod is less than the bottom diameter.

10. The architectural block of claim 8 wherein the at least one guide rod curves from the point where it leaves the first side to the point where it enters the second side of the block.

11. The architectural block of claim 10 wherein the second block at least one guide rod is approximately the same as the bottom opening so that the bottom opening is approximately centered relative to the architectural block first opening when the second block is placed on the architectural block with the at least one guide rod within the bottom opening of the second block.

12. The architectural block of claim 8 further comprising at least one second guide rod extending from within one side of the block and across the at least one first block opening to a different side of the block.

13. The architectural block of claim 12 wherein the second guide rod is further described as passing above the first block opening and is approximately parallel to the at least one first guide rod.

14. The architectural block of claim 12 wherein the second guide rod is further described as not being parallel to the first guide rod and is defined as passing above the first block opening and passing under the at least one first guide rod to form the partial framework of a dome above the architectural block.

15. The block of claim 11 further comprising at least one external surface and a finishing means and where said finishing means further comprises an embedded end where said embedded end is within the at least one external surface of the block and where said finishing means further comprises an exposed end and where said exposed end is not embedded within the at least one external surface.

16. The block of claim 15 wherein the block second side further comprises at least one finishing means for finishing the exterior of the block.

17. The block of claim 15 wherein the finishing means embedded end comprises a large end having an embedded width and wherein the exposed end has an exposed width which exposed width is less than the embedded width.

18. The block of claim 15 wherein the finishing means is from the group comprised of a stud, a bolt, a nail, a brick and a metal plate.

19. The block of claim 15 wherein the finishing means comprises a plurality of finish pieces said pieces having an exposed side and an embedded side where the embedded side is within the block so that the finish pieces are partially embedded within the first side.

20. The block of claim 19 wherein the finish pieces are bricks.

* * * * *